US010434371B2

(12) United States Patent
Shoffler

(10) Patent No.: US 10,434,371 B2
(45) Date of Patent: Oct. 8, 2019

(54) ADJUSTABLE PROPRIOCEPTIVE NEUROMUSCULAR TRAINER

(71) Applicant: ESS 3 TECH, LLC, Bethlehem, PA (US)

(72) Inventor: David Aloysuis Shoffler, Elysburg, PA (US)

(73) Assignee: ESS 3 Tech, LLC, Bethlehem, PA (US)

( * ) Notice: Subject to any disclaimer, the term of this patent is extended or adjusted under 35 U.S.C. 154(b) by 122 days.

(21) Appl. No.: 15/272,200

(22) Filed: Sep. 21, 2016

(65) Prior Publication Data

US 2018/0078822 A1 Mar. 22, 2018

(51) Int. Cl.

| | |
|---|---|
| ***A63B 22/16*** | (2006.01) |
| ***A63B 26/00*** | (2006.01) |
| ***A63B 22/18*** | (2006.01) |
| *A63B 71/00* | (2006.01) |

(52) U.S. Cl.

CPC ..... *A63B 26/003* (2013.01); *A63B 22/18* (2013.01); *A63B 2071/0072* (2013.01); *A63B 2220/40* (2013.01); *A63B 2220/803* (2013.01); *A63B 2220/833* (2013.01); *A63B 2225/62* (2013.01)

(58) Field of Classification Search

CPC ..... A63B 22/16; A63B 22/18; A63B 26/003; A63B 2026/006; A63B 2022/0033; Y10T 403/32041; Y10T 403/32081; Y10T 403/32278

See application file for complete search history.

(56) References Cited

U.S. PATENT DOCUMENTS

| | | | | |
|---|---|---|---|---|
| 2,438,839 A * | 3/1948 | Beeh | F01B 3/0085 | 403/215 |
| 4,279,107 A * | 7/1981 | Bollmann | E02D 27/42 | 403/86 |
| 5,409,226 A * | 4/1995 | Mesko | A63F 13/06 | 273/148 B |
| 5,813,958 A * | 9/1998 | Tomita | A61H 1/0266 | 482/146 |
| 6,017,010 A * | 1/2000 | Cui | F16C 11/106 | 248/181.1 |
| 6,249,983 B1 * | 6/2001 | Wright | G01C 9/26 | 33/286 |

(Continued)

FOREIGN PATENT DOCUMENTS

| | | | | |
|---|---|---|---|---|
| AT | 509939 A1 * | 12/2011 | A63B 22/18 | |
| DE | 102007048399 A1 * | 4/2009 | A63B 22/16 | |
| GB | 1372342 A * | 10/1974 | A63B 23/04 | |

*Primary Examiner* — Joshua T Kennedy

(74) *Attorney, Agent, or Firm* — Plumsea Law Group, LLC

(57) ABSTRACT

Proprioceptive neuromuscular training device for exercisers that improves balance and coordination throughout the kinetic chain. Comprised of a center assembly containing two pivots connecting a top surface to a bottom surface. A top pivot is set within the top surface, a lower pivot is set medial the top surface and the base surface. Both pivots combined eliminate multiaxial deviation creating appropriate musculoskeletal responses. There are slide and lock assemblies with multiple locking points mounted to the base surface. The slide and lock assembly is comprised of an adjustable angle stop containing a protrusion that locks into a groove to either restrict or increase the multiaxial motion of the top surface based on positioning relative to the center assembly.

13 Claims, 10 Drawing Sheets

(56) References Cited

U.S. PATENT DOCUMENTS

| | | | | |
|---|---|---|---|---|
| 6,428,451 | B1 * | 8/2002 | Hall | A63B 22/18 482/146 |
| 6,624,802 | B1 * | 9/2003 | Klein | A63F 13/06 273/109 |
| 7,241,070 | B2 * | 7/2007 | McMurtry | B25J 17/0266 269/75 |
| 7,775,952 | B1 * | 8/2010 | Curran | A63B 22/18 482/146 |
| 8,435,164 | B2 * | 5/2013 | VanBuren | A63B 26/003 482/145 |
| 8,986,180 | B1 * | 3/2015 | VanBuren | A63B 4/00 482/145 |
| 9,446,307 | B2 * | 9/2016 | Klein | A63F 13/807 |
| 9,731,163 | B2 * | 8/2017 | Henson | A63B 22/18 |
| 2007/0184953 | A1 * | 8/2007 | Luberski | A63B 22/18 482/146 |
| 2009/0227426 | A1 * | 9/2009 | Dubar | A63B 21/0004 482/34 |
| 2016/0199699 | A1 * | 7/2016 | Klassen | A63B 22/16 482/146 |
| 2018/0193693 | A1 * | 7/2018 | Youm | A63B 26/003 |

* cited by examiner

ADJUSTABLE PROPRIOCEPTIVE NEUROMUSCULAR TRAINER

CROSS-REFERENCE TO RELATED APPLICATION(S)

This application claims the benefit of and incorporates by reference U.S. Provisional Application No. 62/299,773 filed Feb. 25, 2016.

FIELD OF THE INVENTION

The Adjustable Proprioceptive Neuromuscular Trainer (APNT) is a proprioceptive training device that is systematically modifiable and progressively challenging for its user.

BACKGROUND

The present invention relates generally to proprioception training devices. Currently all other proprioceptive balance training devices such as wobble boards and rocker boards contain a major flaw in neuromuscular proprioceptive training concepts. The major flaw is that the pivot point is on the ground which results in the entire training surface deviating from the vertical midpoint and shifting the user's center of mass. The new center of mass forces the longitudinal axis to shift which results in trunk and spinal column compensation. The deviation of the vertical midpoint and new center of mass leads to alterations in stability and neuromuscular control, as well as faulty movement patterns, tissue overload, arthrokinematic inhibition, altered force-couple relationships, and altered reciprocal inhibition which ultimately results in synergistic dominance and forces transferred to other portions of the kinetic chain. When forces are transferred to other portions of the kinetic chain this creates overload of the feedback-control circuit between the central nervous system and musculoskeletal system and inhibits appropriate kinesthetic conscious awareness and muscle coordination necessary to maintain balance. All of the current balance training devices create abnormal sensory input, slow activating prime movers and reliance and recruitment of synergists and stabilizers.

BRIEF SUMMARY

Relating generally to proprioceptive balance training devices a top surface and a bottom surface connected with a center assembly that contains a top pivot at the level of the top surface minimizing multiaxial deviation of the top surface from vertical midpoint. A combination of pivot locations moves the top surface in a natural up and down motion with no side to side shifting. A longitudinal axis remains centered directly over both pivots allowing for appropriate movement sequencing which creates appropriate musculoskeletal responses during functional movement creating maximal joint stabilization and maximal sensory input into the central nervous system. The appropriate neuromuscular responses increase the body's ability to maintain its center of gravity over its base of support allowing for transferable functional movement patterns to be produced and improved.

Other differentiating features include the ability to adjust the resistance on the top surface and the angles of travel of the top surface allowing the user to progress the intensity and train symmetrically or asymmetrically. The ability to adjust the resistance is accomplished using an air bladder between the top and bottom surfaces and around the center assembly to adjust the level of resistance placed on the top surface. While the angles of travel can be adjusted using the slide and lock mechanism with travel stops. An optional accessory that can be locked into the slide and lock mechanism is the rocker board conversion assembly which limits the top surfaces travel to two planes of motion and makes the APNT function as a rocker board.

DETAILED DESCRIPTION

Figure 1:
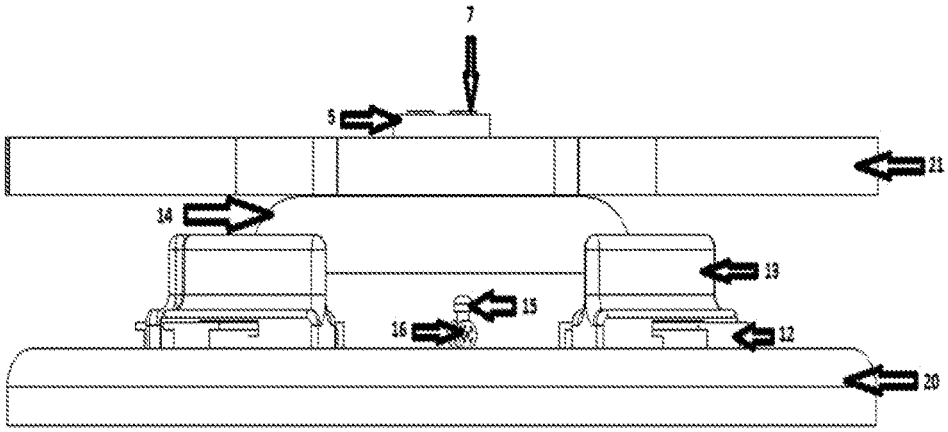
FIG. 1. is a side view of the entire APNT according to the present invention.
Figure 2:
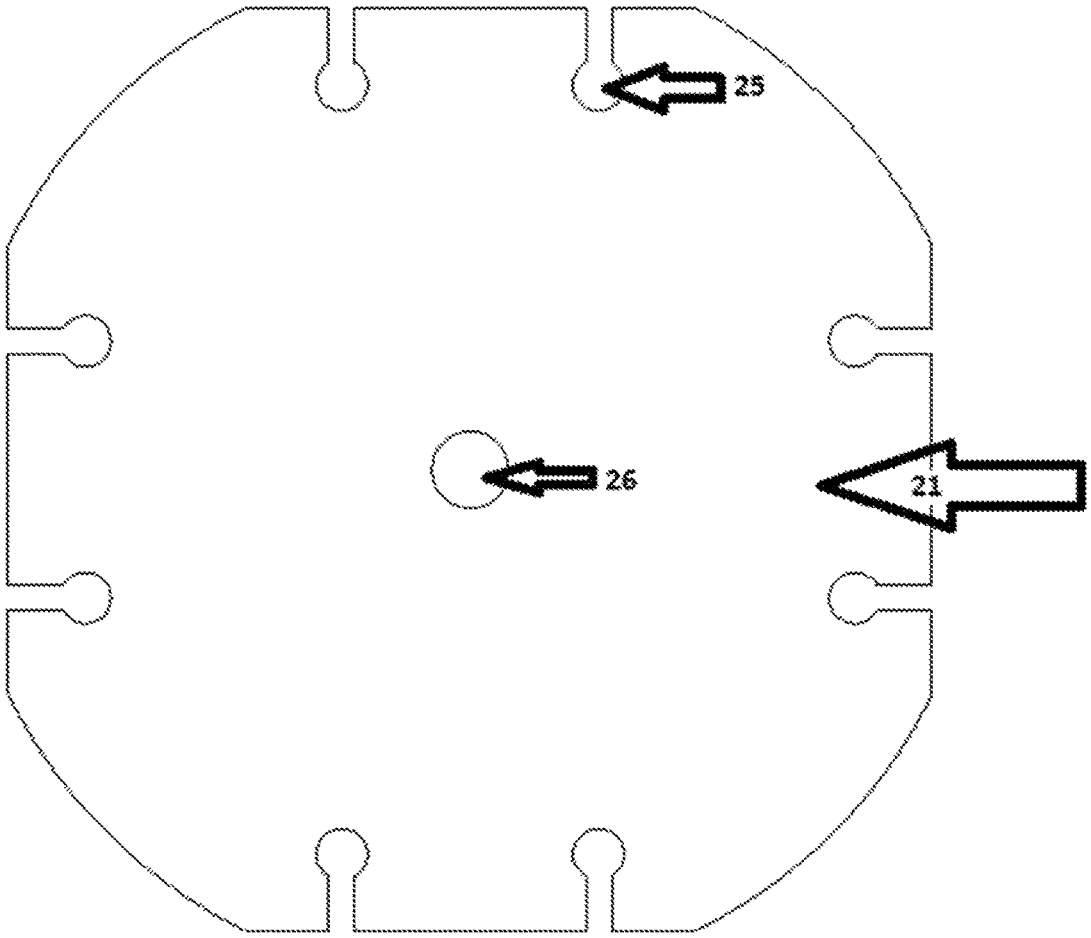
FIG. 2. is a top view of the top surface accessory mounting slots and the top center alignment hole according to the present invention.
Figure 6:
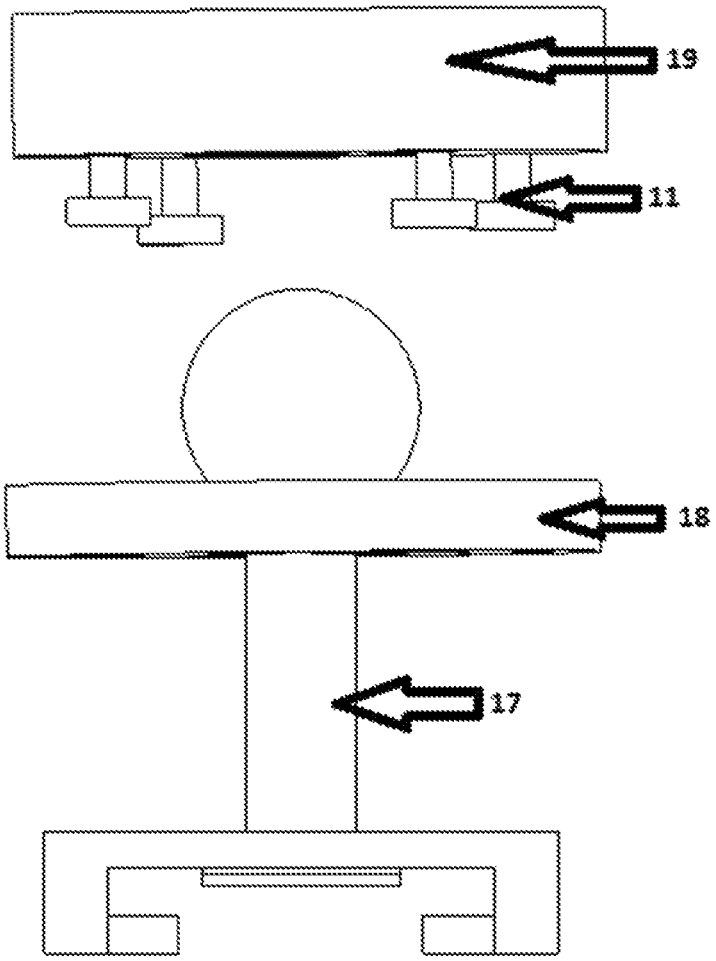
FIG. 6. is an exploded view of the rocker board conversion assembly according to the present invention.

The Adjustable Proprioceptive Neuromuscular Training (APNT) device (FIG. 1) is a progressively challenging proprioceptive training device that is adjusted, progressed or regressed using an adjustable resistance air bladder 14 adjustable angle travel stops 13 or the rocker board conversion assembly (FIG. 6).

Figure 3:
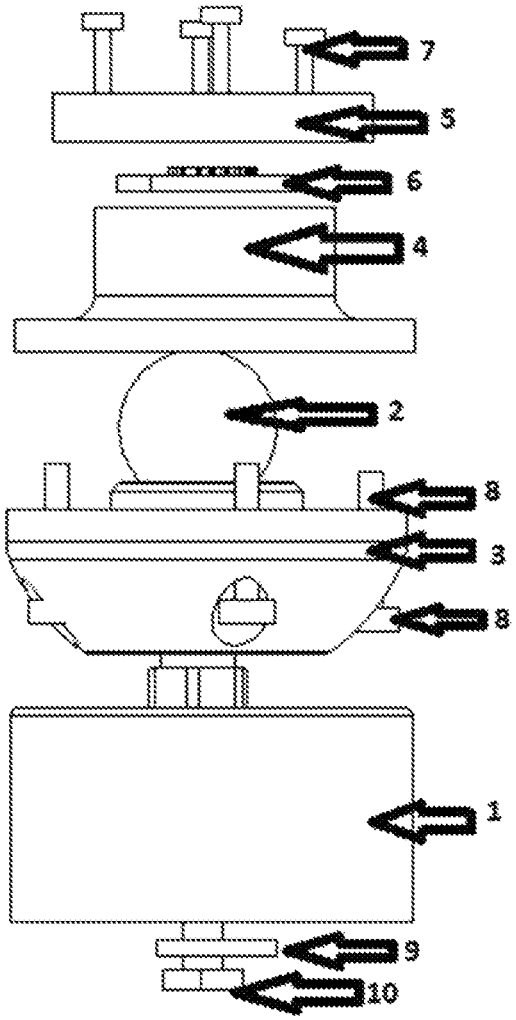
FIG. 3. is a exploded view of the center assembly according to the present invention.
Figure 3B:
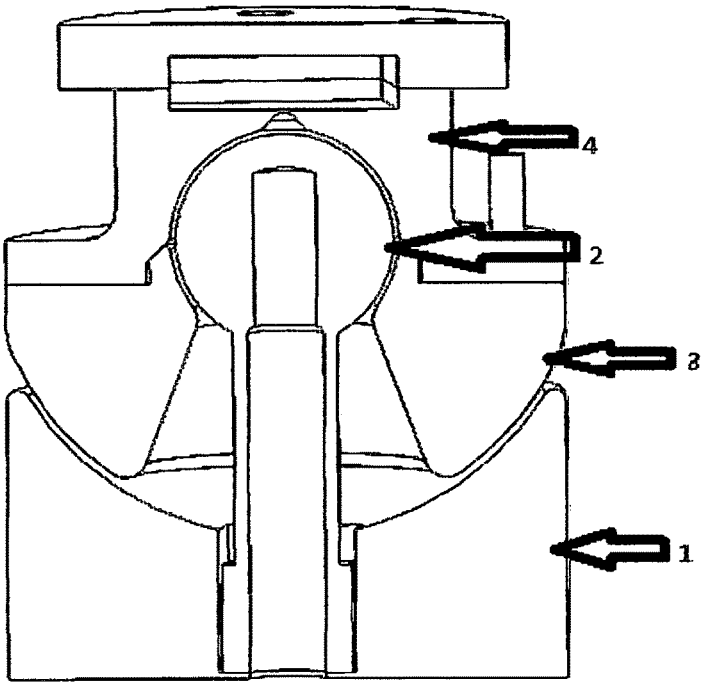
FIG. 3B is an assembled cross-sectional view of the center assembly shown in FIG. 3.

A user is in contact with the top surface 21. The top surface 21 comprising accessory mounting slots 21 and a top center alignment 26. The top center alignment 26 allows a center assembly (FIG. 3) to enter the top surface 21 creating a top pivot 2 at the top surface 21 which makes the top surface 21 wobble or rock multiaxially or bi-laterally at various angles. A center assembly (FIG. 3) allows the top surface 21 to move up and down multiaxially using the top pivot 2 and lower pivot 3.

Enclosed in an upper hollow cavity 4 is a computer sensor 6. The computer sensor 6 is above the pivot ball 2 which is enclosed in a lower cavity 3 and upper hollow cavity 4 held together with a mounting screw 8 through the lower cavity 3 and upper cavity 4 entering top surface 21 enclosing the top pivot 2. A lower pivot 3 rests on lower pivot base 1 connected to a bottom surface 20 using a center bolt 10 and a washer 9 passing through the bottom surface 20, lower pivot base 1, lower pivot 3 and threaded into top pivot 2 connecting top surface 21 and bottom surface 20.

Figure 4:
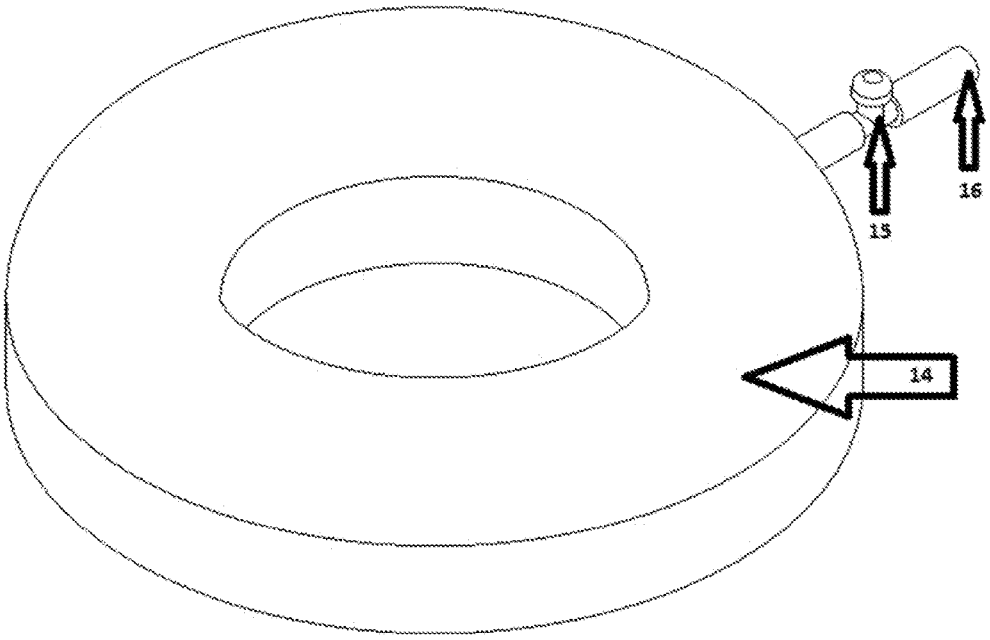
FIG. 4. is a view of the air bladder system according to the present invention.

As shown in FIG. 4 the air bladder system goes around center assembly (FIG. 3) and is between the top surface 21 and bottom surface 20 and includes an air inlet 16 which is attached to an air release valve 15 that enters the air bladder 14 on the side. The air inlet 16 allows the user to add air to the air bladder 14 which places resistance on the top surface 21 and forces the top surface 21 to move in a more controlled motion. The air release valve 15 allows the user to release air from the air bladder 14 removing resistance from the motion of the top surface 21 and allowing the top surface 21 to move with less control for more advanced users.

Figure 5:
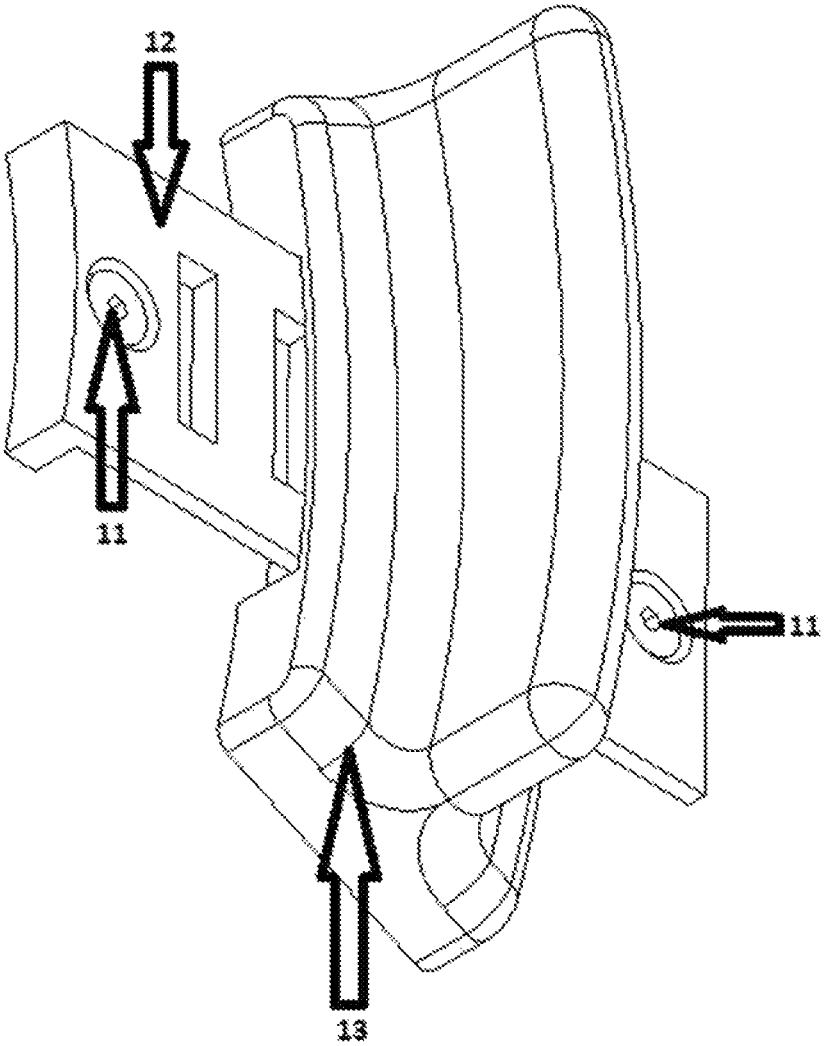
FIG. 5. is a top view of the sliding and lock adjustable angle stop system according to the present invention.
Figure 5B:
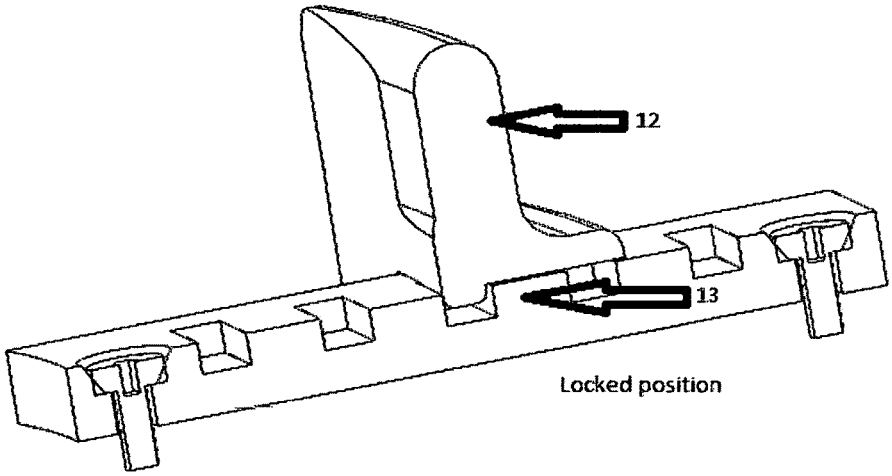
FIG. 5B is a perspective cutaway cross-sectional view of the adjustable angle stop system of FIG. 5 shown in a locked condition.
Figure 5C:
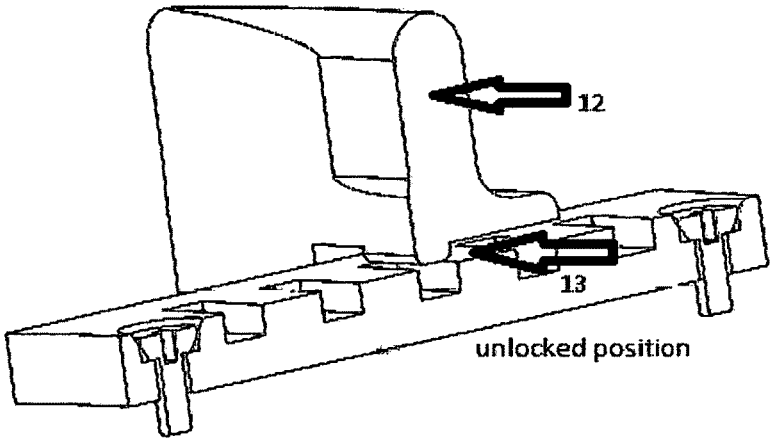
FIG. 5C is a perspective cutaway cross-sectional view of the adjustable angle stop system of FIG. 5 shown in an unlocked condition.

A slide and lock adjustable angle stop system is mounted to the bottom surface 20 outside of an air bladder system (FIG. 4). The slide and lock adjustable angle stop system (FIG. 5) allows the user to adjust the angular motion of the top surface 21 using an adjustable angle stop 13 which slides and locks on a slide and lock mechanism 12. The adjustable angle stop 13 can be set and locked closer to the center assembly (FIG. 3) to increase the travel of the top surface 21 or set and locked further away from the center assembly (FIG. 3) to reduce the angular travel of the top surface 21 allowing for multiple angular motions of the top surface 21.

As shown in FIG. 6 the rocker board conversion assembly contains a rocker board conversion top cavity 19, cavity closing screws 11, rocker board conversion pivot 17, and a rocker board conversion bottom cavity 18. The rocker board conversion assemblies (FIG. 6) attach to two linear slide and lock mechanisms 12 to convert the adjustable wobble proprioceptive training device into an adjustable rocker proprioceptive training device.

Figure 7:
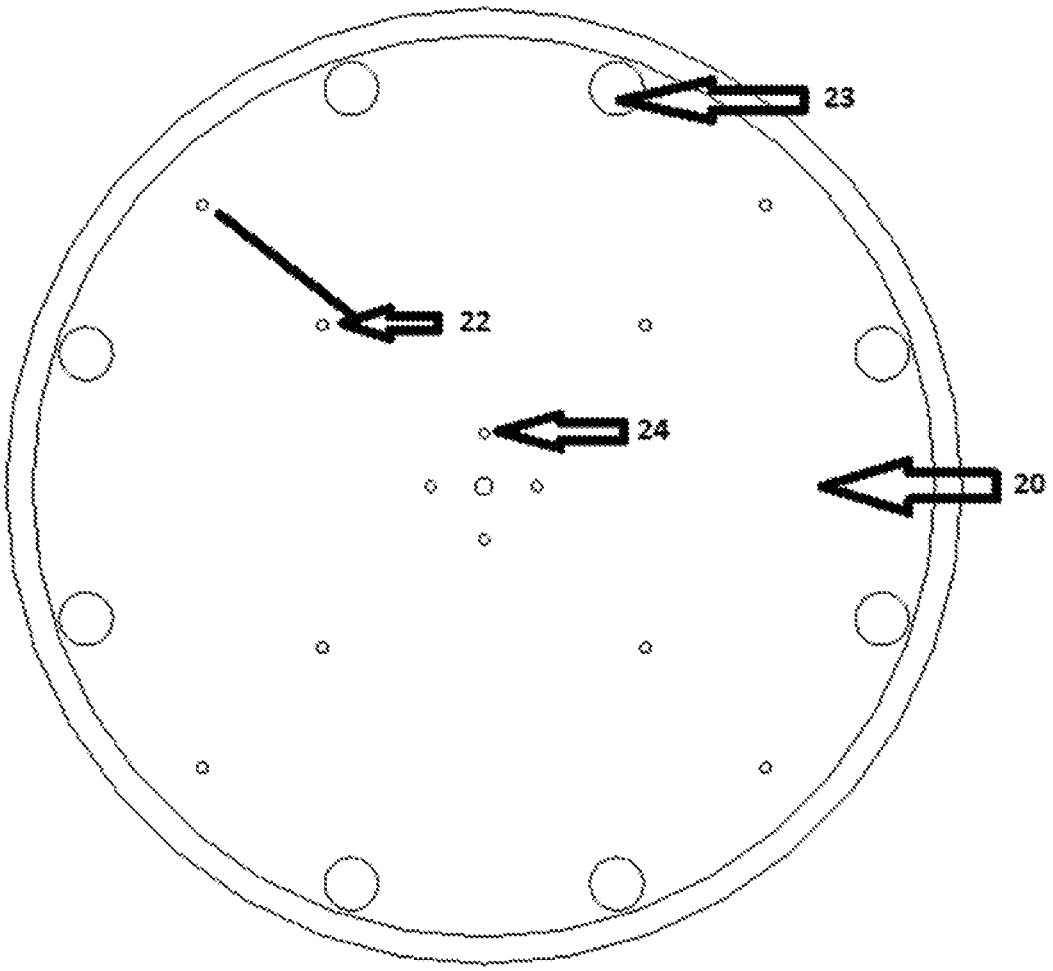
FIG. 7. is a top view of the bottom surface including the slide and lock mounting holes, accessory mounting holes and the center alignment holes according to the present invention.

As shown in FIG. 7 the bottom surface 20 contains accessory mounting holes 23 slide and lock mounting holes 22 and center assembly alignment holes 24. The bottom surface 20 provides a base of support for the APNT (FIG. 1) and connects with the top surface 21 through the center assembly (FIG. 3) allowing the top surface 21 to wobble or rock with minimal multiaxial deviation from the vertical midpoint.

While different embodiments of the invention have been described in detail herein, it will be appreciated by those skilled in the art of various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

The invention claimed is:

1. A balance board, comprising:

an upper plate having a top surface configured for a user to stand on;

a base configured to contact the ground; and a center assembly pivotally connecting the upper plate with the base, the center assembly including a top pivot including a first multi-axial joint set at least partially within the upper plate and a lower pivot including a second multi-axial joint disposed proximate the upper plate;

wherein the base includes a base surface configured to limit pivotal movement of the upper plate relative to the base; wherein the first multi-axial joint is a first ball and socket joint;

wherein the second multi-axial joint is a second ball and socket joint; and wherein the first ball and socket joint is disposed at least partially within the second ball and socket joint;

the balance board further including an adjustable angle stop system comprising at least one adjustable angle stop configured to slide at adjustable intervals changing a maximum angle by which the upper plate may be pivoted relative to the base.

2. The balance board of claim 1, further including an inflatable annular air bladder extending around the center assembly and between the upper plate and the base.

3. The balance board of claim 2, further including an inflation valve configured to permit adjustment of air pressure within the annular air bladder, wherein air pressure within the annular air bladder affects resistance to pivotal movement between the upper plate and the base.

4. The balance board of claim 1, further including a data tracking device configured to detect and transmit information regarding movement of the upper plate.

5. The balance board of claim 4, wherein the information regarding movement of the upper plate includes data regarding at least one of the location, acceleration, and travel of the upper plate.

6. A balance board, comprising:

an upper plate having a top surface configured for a user to stand on;

a base configured to contact the ground;

a center assembly pivotally connecting the upper plate with the base;

an adjustable angle stop system comprising at least one adjustable angle stop including a lower protrusion configured to be slidably received in a groove in the base, allowing the adjustable angle stop to slide linearly at adjustable intervals changing a maximum angle by which the upper plate may be pivoted relative to the base;

wherein the center assembly includes at least a first ball and socket joint;

wherein the center assembly includes a second ball and socket joint disposed at least partially within the first ball and socket joint; and wherein the first ball and socket joint is disposed at least partially within the upper plate.

7. The balance board of claim 6, wherein the adjustable angle stop is configured to be slidably moved in a substantially radial direction relative to a vertical axis at an approximate center of the balance board.

8. The balance board of claim 6, wherein the balance board includes a plurality of adjustable angle stops disposed around a periphery of the base.

9. The balance board of claim 8, wherein the plurality of adjustable angle stops includes four adjustable angle stops evenly spaced at 90 degree intervals around the periphery of the base; and wherein the balance board is configured to be converted from a multi-axis wobble board to a single-axis rocker board by adjusting opposing adjustable angle stops to prevent pivotal movement in all but one horizontal axis.

10. The balance board of claim 6, further including an inflatable annular air bladder extending around the center assembly and between the upper plate and the base.

11. The balance board of claim 10, further including an inflation valve configured to permit adjustment of air pressure within the annular air bladder, wherein air pressure within the annular air bladder affects resistance to pivotal movement between the upper plate and the base.

12. The balance board of claim 6, further including a data tracking device configured to detect and transmit information regarding movement of the upper plate.

13. The balance board of claim 12, wherein the information regarding movement of the upper plate includes data regarding at least one of the location, acceleration, and travel of the upper plate.

* * * * *